US006709765B2

(12) United States Patent
Walling

(10) Patent No.: US 6,709,765 B2
(45) Date of Patent: Mar. 23, 2004

(54) ORNAMENT

(75) Inventor: James Walling, Calgary (CA)

(73) Assignee: Off The Wall Creations Ltd., Calgary (CA)

( * ) Notice: Subject to any disclaimer, the term of this patent is extended or adjusted under 35 U.S.C. 154(b) by 0 days.

(21) Appl. No.: 10/152,722

(22) Filed: May 23, 2002

(65) Prior Publication Data

US 2003/0219550 A1 Nov. 27, 2003

(51) Int. Cl.[7] ..... B44C 3/08
(52) U.S. Cl. ..... 428/542.2; D11/117; 428/115
(58) Field of Search ..... D11/141, 89, 91, D11/43, 76; D21/458, 467, 441, 443; 428/7, 66.5, 115, 66.7, 542.6, 24, 25, 107, 120, 542.2

(56) References Cited

U.S. PATENT DOCUMENTS 5,718,962 A * 2/1998 Walling ..... 428/99

* cited by examiner

*Primary Examiner*—Deborah Jones
*Assistant Examiner*—Arden Sperty
(74) *Attorney, Agent, or Firm*—George A. Seaby

(57) ABSTRACT

An aesthetic, hangable ornament is produced by cutting a blank in the shape of, e.g. a bird or a butterfly from a laminate of three layers of vinyl, the outer two layers of which are holographic, cutting a hole in the blank, cutting slits in the blank to form a body including strips extending radially from a planar annulus around the hole to the periphery of the body, crimping the strips to incline them by 20–30° from the plane of the annulus, and mounting a multifaceted, polyhedral crystal in the hole using a hook, which is also used to suspend the ornament from a clear line.

5 Claims, 6 Drawing Sheets

ORNAMENT

BACKGROUND OF THE INVENTION

1. Field of the Invention

This invention relates to a hangable ornament.

2. Discussion of the Prior Art

There are many hangable ornaments, the most common of which are mobiles. Mobiles typically include plastic, wooden or metal bodies in the shape of animals, birds or insects. The eye appeal of mobiles is often enhanced by the use of bright colors. By using an irregular surface on the figures, the mobiles can be caused to reflect more light. However, greater complexity of the mobile bodies, results in higher production costs. A need exists for a method of manufacturing an ornament which, while having a relatively complicated body design, is easy to produce. Moreover, there is always room for improvement in the actual design of an ornaments.

GENERAL DESCRIPTION OF THE INVENTION

An object of the present invention is to provide a relatively simple method of producing a hangable ornament.

Another object of the invention is to provide a hangable ornament having a unique body design, which is aesthetic to the eye.

Therefore, according to one aspect, the invention provides a hangable ornament comprising the steps of cutting a planar blank from a sheet of material, forming a circular hole in said blank, cutting slits in said blank to form a body with a planar annulus around the hole and a plurality of strips extending outwardly from the outer periphery of the annulus to the periphery of the body; bending the inner ends of said strips around their longitudinal axes; whereby the body includes a plurality of discrete strips extending radially outwardly from the annulus; and mounting a crystal in said hole.

According to a second aspect, the invention provides a hangable ornament comprising a planar body; an opening in said body; a multi-faceted crystal in said opening; a hook connecting said crystal to said body; a planar annulus surrounding said hole; and a plurality of discrete, elongated strips radiating outwardly from said annulus to a peripheral side edge of the body, said strips being inclined slightly from the plane of the annulus, whereby a side edge of each strip is in a different plane from a side edge of an adjacent strip.

BRIEF DESCRIPTION OF THE DRAWINGS

The invention is described below in greater detail with reference to the accompanying drawings, wherein.

DESCRIPTION OF THE PREFERRED EMBODIMENT

Referring to FIGS. 1 to 4, the first step in producing a hangable ornament in accordance with the present invention is to cut a blank 1 with the desired shape (in this case a butterfly with a circular hole 2 in it) from a sheet of material (not shown). In the present case, the preferred material is a laminate defined by three layers of vinyl, the center layer being clear and the outer layers being holographic vinyl. The holographic vinyl layers are 0.003 inch thick, and typically the clear layer is relatively stiff and 0.009 inch thick The holographic vinyl having a variety of embedded designs is typically available in rolls with pressure sensitive adhesive on one side covered by a peel-off backing. The backing is removed and the vinyl is adhered to both sides of the central layer. Because it is quite stiff, the clear vinyl comes in flat sheets. If the clear vinyl was rolled, because of its inherent memory, it would tend to curl.

Figure 1:
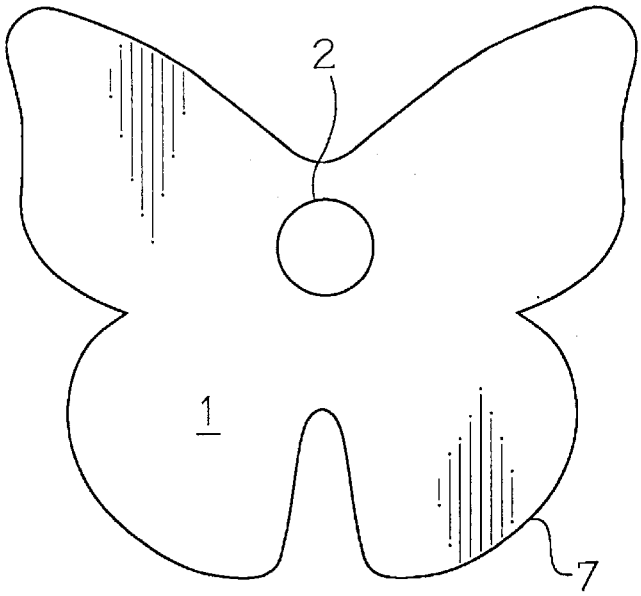
FIG. 1 is a front view of a blank used to produce a hangable ornament in accordance with the invention.
Figure 2:
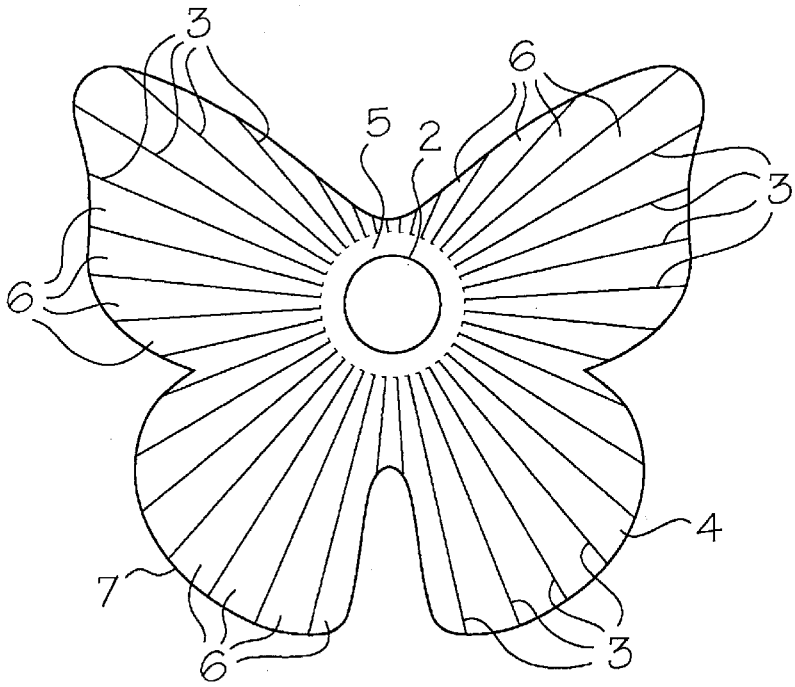
FIG. 2 is a front view of the blank of FIG. 1 following a cutting operation.
Figure 3:
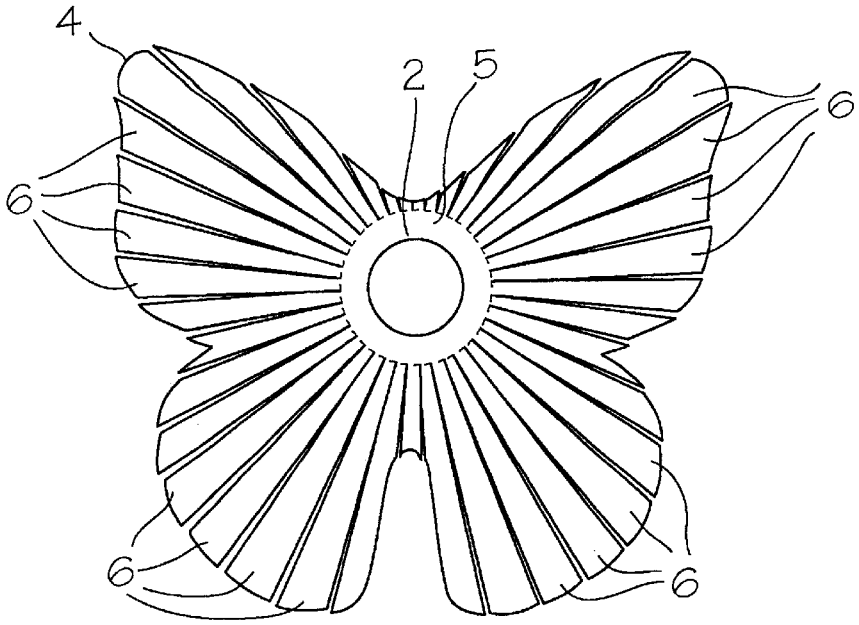
FIG. 3 is a front view of the blank of FIGS. 1 and 2 following a crimping operation.
Figure 4:
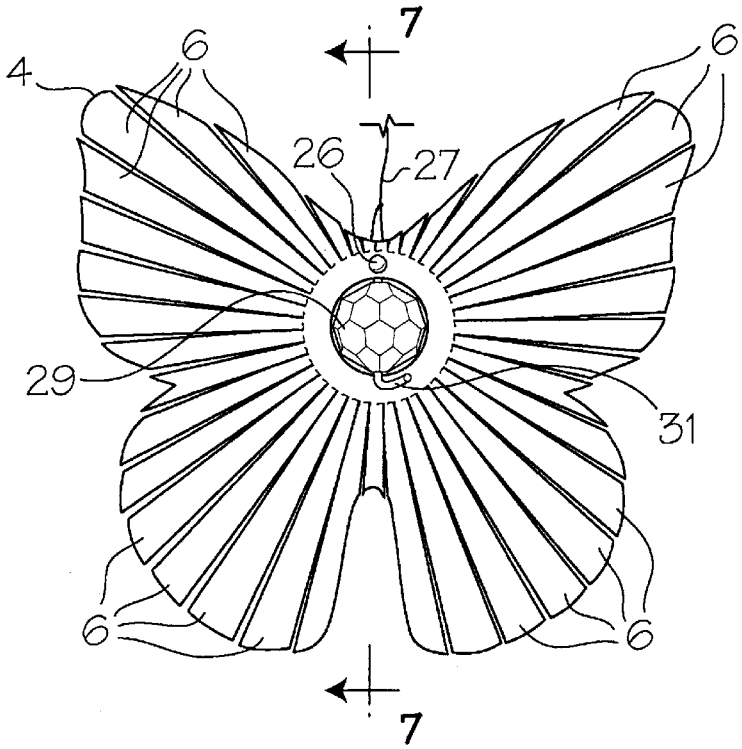
FIG. 4 is a front view of a finished ornament.
Figure 5:
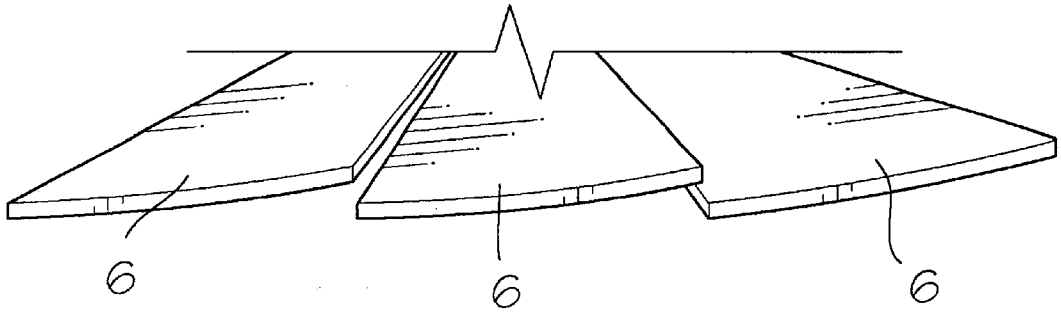
FIG. 5 is a perspective view of a side edge of a small area of the blank following the cutting operation.
Figure 6:
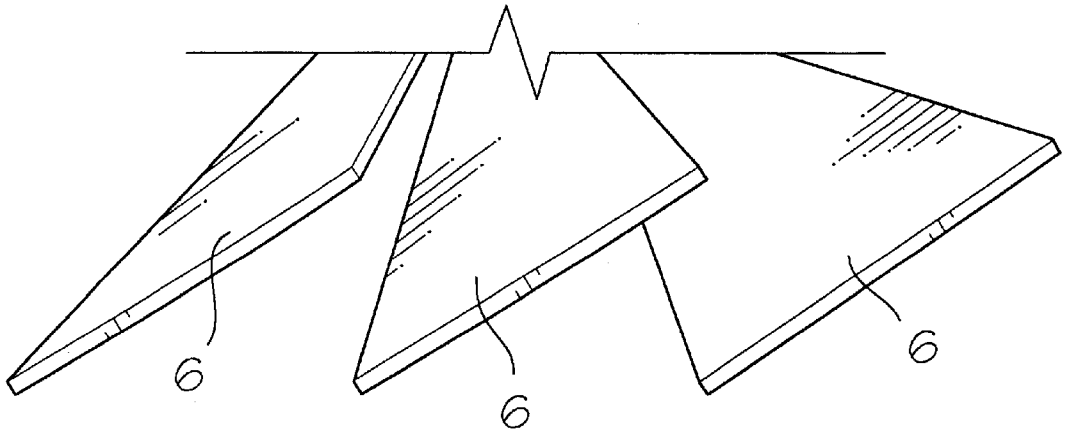
FIG. 6 is a perspective view of the area of side edge shown in FIG. 5 following the crimping operation.
Figure 8:
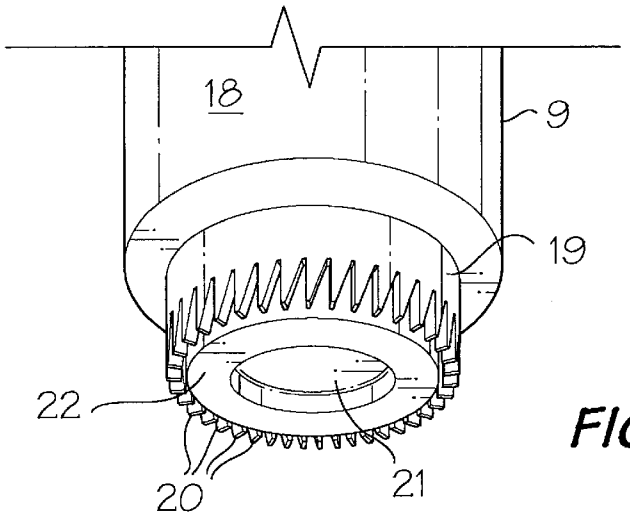
FIG. 8 is a perspective view of a crimping head used to produce the ornament of FIG. 4.
Figure 9:
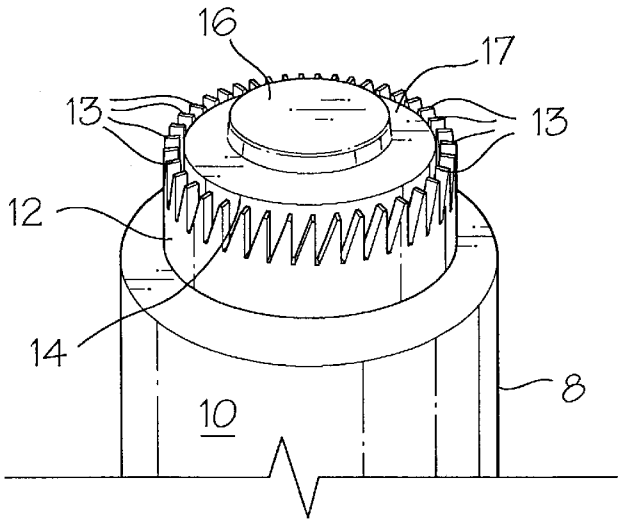
FIG. 9 is a perspective view of a mandrel used to produce the ornament of FIG. 4.

The next step in the method is to cut a plurality of slits 3 in the blank 1 to form a body 4 (FIG. 2) with a planar annulus 5 around the hole 2 and a plurality of strips 6 extending radially outwardly from the outer periphery of the annulus 5 to the outer periphery 7 of the body. The slits 3 are precisely nine degrees apart, making forty strips 6, which have the same width at their inner ends, i.e. the ends adjacent to the annulus 5. As best shown in FIG. 5, when the slits 3 are cut, there is a certain amount of crimping, i.e. transverse bending of the strips 6 occurs. By "transverse bending" is meant that the strips 6 are bent around their longitudinal axis so that one side edge is slightly above and the other side edge is below the plane of the annulus.

The strips 6 are then crimped at their inner ends using a crimping apparatus, so that the strips 6 are inclined laterally approximately 20–30° from the plane of the annulus 5.

Crimping of the strips 5 is effected using a crimping machine, which includes a fixed mandrel 8 and a head 9 which is slidably mounted for reciprocating, vertical movement above the mandrel 8. Reciprocation of the head 9 can be effected by any suitable means, e.g. a circular cam eccentrically mounted on one end of a driven shaft and engaging a roller on a top end of the head 9. The mandrel 8 includes a cylindrical post 10 with a smaller diameter sleeve 12 on the top end thereof. The top end of the sleeve 12 includes teeth 13 with a sawtooth configuration, one side of each tooth being vertical and the other side being inclined. A shaft 14 mounted in the sleeve 12 is supported by a spring (not shown) in a central, longitudinally extending bore in the post 10. Thus, the shaft 14 is free to move longitudinally in the post 10 to a depth equal to half the length of the teeth 13 when pressure is applied to the top end thereof. A disc 16 on the top end 17 of the shaft 14 retains a body 4 on the mandrel for crimping.

The head 9 is axially aligned with and similar in structure to the mandrel 8. The head 9 includes a tubular body 18 with a narrow diameter sleeve 19 at the bottom end thereof. The bottom end of the sleeve 19 has teeth 20, which are the same shape as the teeth 13 on the sleeve 12 and complementary thereto. Opposed teeth 13 and 20 on the mandrel 8 and the head 9 have one straight side and one steeply inclined side, so that when the head 9 is moved downwardly against the mandrel 8, the teeth mesh perfectly. A recess 21 in the bottom end of a shaft 22 in the sleeve 18 receives the disc 16 when the teeth 13 and 12 are meshing. The shaft 22 is also vertically movable in the body 17 of the head, and is spring loaded for applying pressure during crimping to prevent any movement of the body 4 and for returning to a rest position after the head 9 moves away from the mandrel 8.

Figure 11:
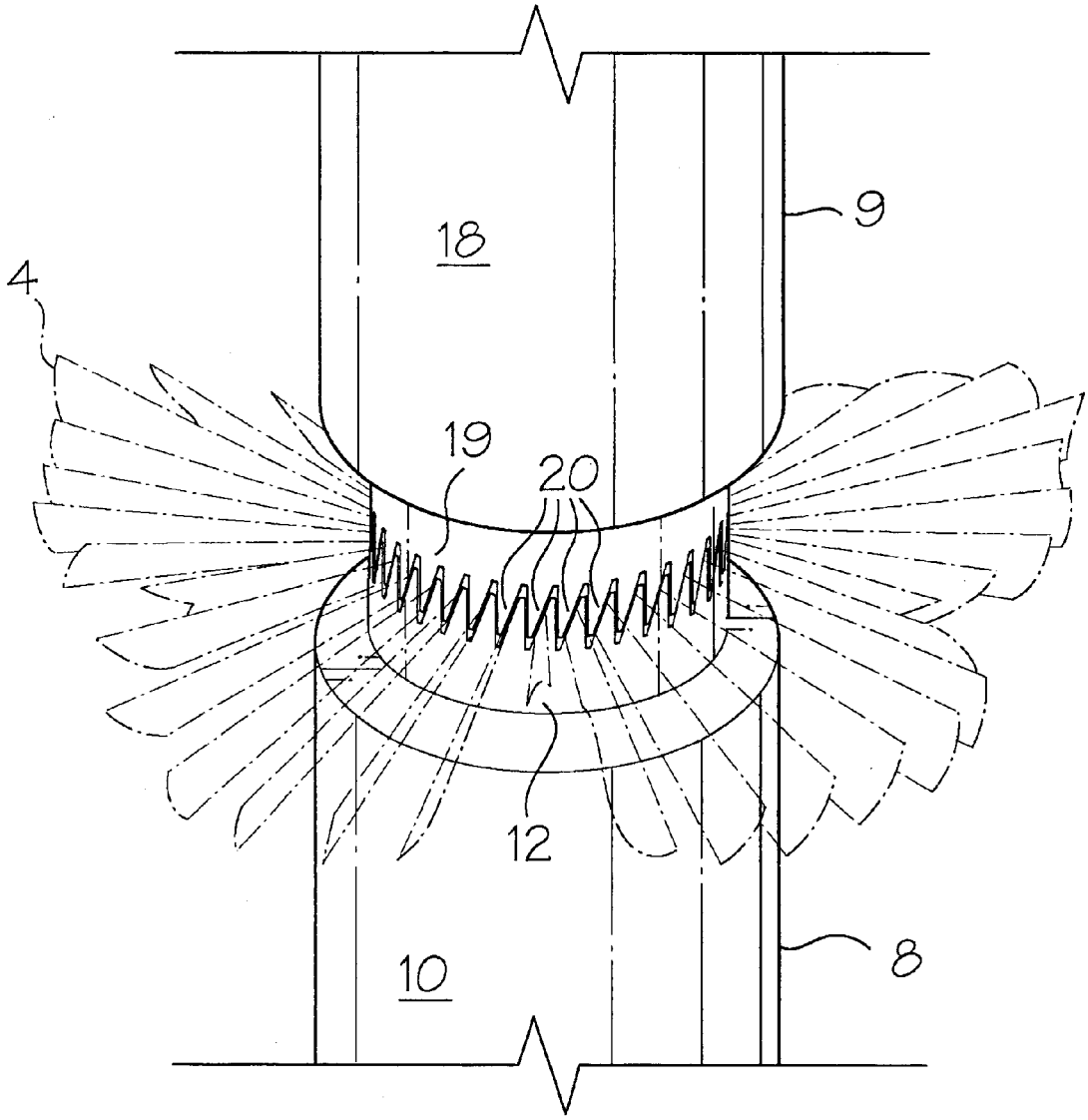
FIG. 11 is a perspective view of the crimping head and mandrel immediately before the end of a crimping operation.

During each crimping operation, with the head 9 spaced apart from the mandrel 8, a body 4, which has already been slit, is placed on the mandrel 8 with the disc 16 in the hole 2 and the body 4 resting on the top of the teeth 13. The slits are aligned with the teeth 13 by gently rotating the body 4 while pressing gently downwardly until the teeth click into position. The head 9 is moved slowly downwardly so that the teeth 13 and 20 mesh (FIG. 11). One hit with the crimping head 9 is sufficient to permanently crimp the strips.

Figure 7:
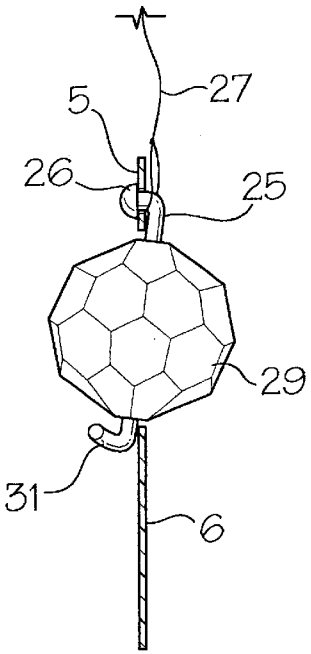
FIG. 7 is a cross section taken generally along line 7—7 of FIG. 4.
Figure 10:
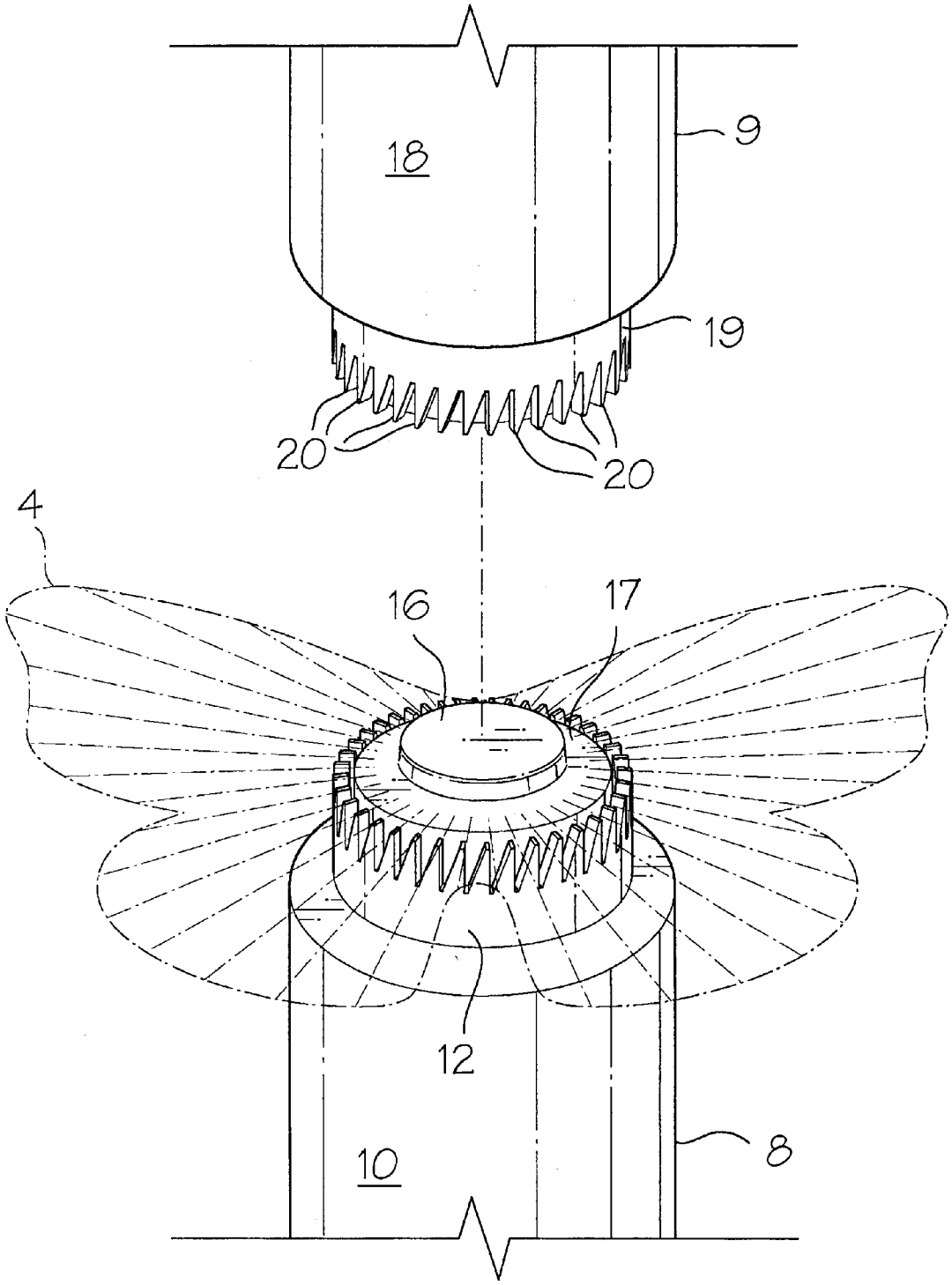
FIG. 10 is a perspective view of the crimping head and mandrel of FIG. 7 with an ornament blank in position for a crimping operation.

A hole is pierced in the top of the annulus 5. A 20 mm long pin 25 (FIGS. 4 and 7), which is bent 90° adjacent to its head 26 is inserted into the hole. A loop of clear fishing line 27 is placed on the pin 25, and a multifaceted, polyhedral crystal 29 with a hole bored through the center thereof is slid onto the pin 25. The free end 31 of the pin 30 is passed through the central hole and then bent to prevent the crystal 29 falling off.

The thus produced ornament reflects sunlight or artificial light, the strips 6 providing reflective surfaces at various angles, and the crystal 29 acts as a prism. The use of the holographic outer layers on the laminate results in changing patterns and colors, depending on the vantage point of the viewer.

I claim:

1. A hangable ornament comprising a planer body; an opening in said body; a planar annulus surrounding said opening; a multi-faceted crystal in said opening surrounded by said annulus; a pin connecting said crystal to said body; and a plurality of discrete, elongated strips contiguous with and extending radially outwardly from said annulus to a peripheral side edge of the body, said strips being in the same plane as the annulus and inclined slightly from the plane of the annulus, whereby a side edge of each strip is in a different plane from a side edge of an adjacent strip.

2. The ornament of claim 1, wherein said body is a laminate including a clear central layer sandwiched between outer layers of holographic material.

3. The ornament of claim 2, wherein the central layer is clear vinyl, and the outer layers are holographic vinyl.

4. The ornament of claim 3, wherein said strips are bent at an angle of 20–30° from the plane of the annulus.

5. The ornament of claim 4, wherein said body includes forty strips of the same width at inner, annulus ends thereof.

* * * * *